United States Patent [19]

F'Geppert

[11] 4,310,146

[45] Jan. 12, 1982

[54] MOTOR-DRIVEN WINCH HAVING INTERNAL SPEED REDUCER

[75] Inventor: Erwin F'Geppert, Novi, Mich.

[73] Assignee: The United States of America as represented by the Secretary of the Army, Washington, D.C.

[21] Appl. No.: 108,897

[22] Filed: Dec. 31, 1979

[51] Int. Cl.[3] ..... B66D 1/22

[52] U.S. Cl. ..... 254/342; 74/713; 254/344

[58] Field of Search ..... 254/344, 343, 342; 74/417, 423, 713

[56] References Cited

U.S. PATENT DOCUMENTS

| | | | |
|---|---|---|---|
| 562,790 | 6/1896 | Armington | 254/344 X |
| 672,013 | 4/1901 | Rydberg | 254/344 |
| 1,235,132 | 7/1917 | Gaylord et al. | 254/342 X |
| 1,637,818 | 8/1927 | Hawkins | 254/344 |
| 1,953,151 | 4/1934 | Cahill | 254/342 |
| 2,363,093 | 11/1944 | Sprake | 254/342 X |
| 3,367,633 | 2/1968 | Kratzer et al. | 254/344 X |

*Primary Examiner*—John M. Jillions

*Attorney, Agent, or Firm*—Peter A. Taucher; John E. McRae; Nathan Edelberg

[57] ABSTRACT

A motor-driven winch wherein the motor is at least partially contained within the winding drum, thereby providing a compact small size unit. The space within the drum also contains a speed reducer of the differential motion type. Speed reducer design is such as to achieve very large speed reduction within a relatively small space, thus contributing to a compact overall design.

1 Claim, 5 Drawing Figures

MOTOR-DRIVEN WINCH HAVING INTERNAL SPEED REDUCER

BACKGROUND AND SUMMARY OF THE INVENTION

This invention relates to a motor-driven winch, and especially to a speed reducer mechanism operatively located between the motor shaft and winding drum. The speed reducer includes two gears driven by the motor shaft at slightly different speeds in opposite directions. A third gear simultaneously meshes with the oppositely rotating gears so that the third gear is caused to slowly orbit around the motor shaft axis; the winding drum is carried by the third gear, and thus rotates at the third gear speed. Very high speed reduction, e.g. 400 to 1, is obtainable within a very small size envelope.

Use of this speed reducer design enables the speed reducer to be housed within the winding drum; the motor is also at least partially telescoped into the drum. Since the drum serves as a housing for the speed reducer the size and weight of the total unit is somewhat reduced.

The invention described herein may be manufactured, used, and licensed by or for the Government for governmental purposes without payment to me of any royalty thereon.

THE DRAWINGS

Figure 1:
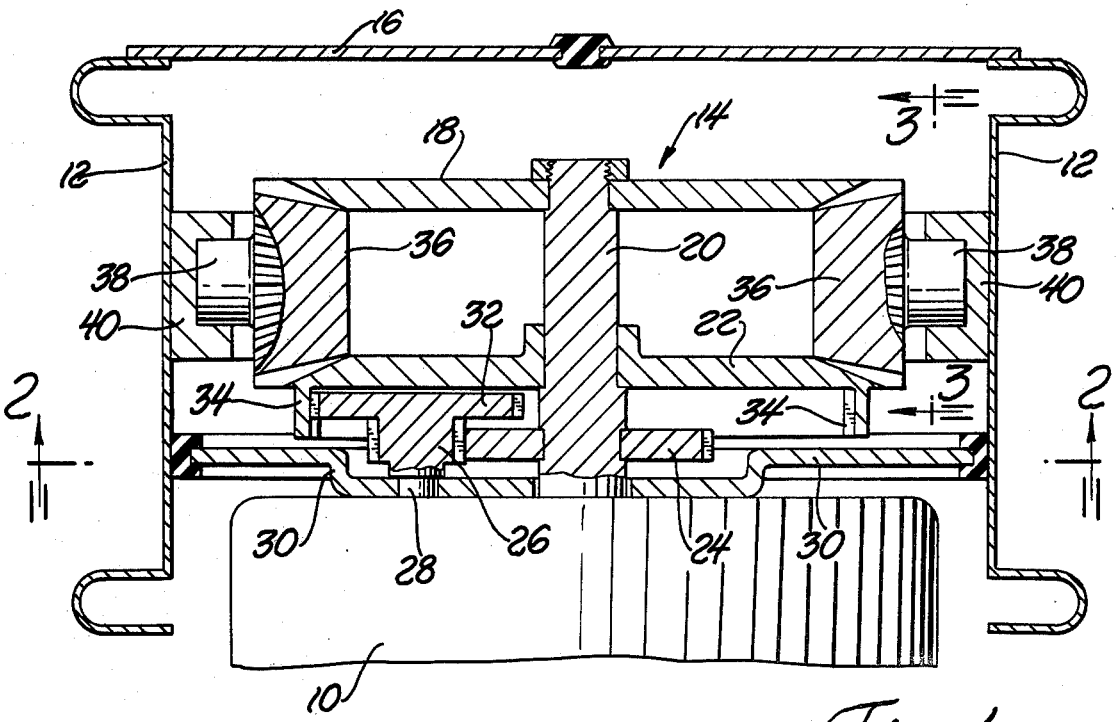
FIG. 1 is a fragmentary sectional view taken through a motor-operated winch embodying my invention.
Figure 2:
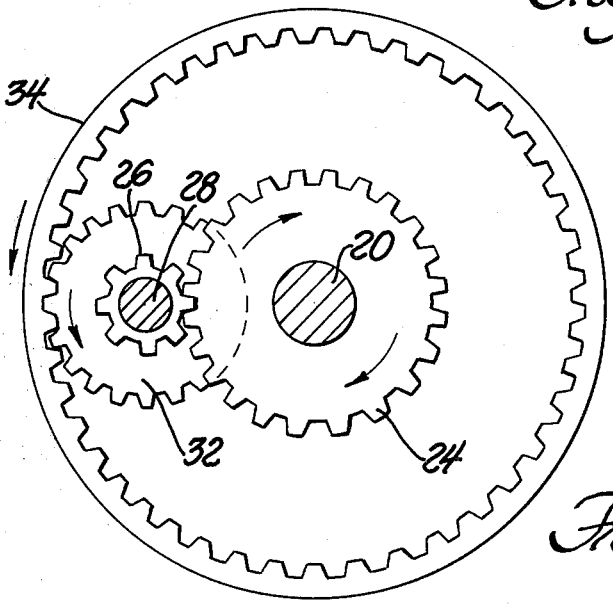
FIG. 2 is a sectional view taken on line 2—2 in FIG. 1.
Figure 3:
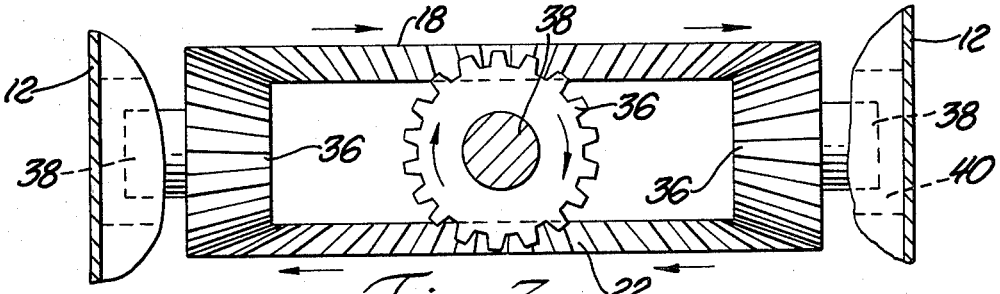
FIG. 3 is a sectional view taken on line 3—3 in FIG. 1.

Referring in greater detail to FIGS. 1 through 3, there is shown a motor-operated winch comprising a motor (electric or hydraulic) 10, winding drum 12, and speed reducer 14. The motor is partially telescoped into the drum; the speed reducer is contained within the space between the end of the motor and end wall 16 of the drum. My invention relates especially to the construction of the speed reducer.

The speed reducer includes a first bevel gear 18 affixed to motor shaft 20 and a second bevel gear 22 floatably or freely positioned on the motor shaft. A system of pinion gears is located below gear 22 to provide a reverse drive connection from the shaft to the bevel gear. The term "reverse" is here used to mean a direction opposite to that taken by bevel gear 18. For example, if shaft 20 drives gear 18 in a clockwise direction then gear 22 will be driven in a counterclockwise direction.

The system of pinion gears includes a first pinion gear 24 affixed to shaft 20, and a second relatively small pinion gear 26 that includes a stub shaft 28 mounted for rotation on a stationary plate 30. Plate 30 is suitably secured to motor 10; the plate serves as a mounting device for gear 26 and also as a barrier against escape of gear lubricant out of the space between itself and drum end wall 16. Plate 30 may have sections thereof spaced from motor 10 to facilitate passage of cooling air through the motor interior. Gear 26 is integral with a third relatively large pinion gear 32 that meshes with a large ring gear 34 carried by bevel gear 22. The pinion gear system constitutes a drive connection between shaft 20 and bevel gear 22.

The number of pinion gears is selected so that gear 22 is driven in a different (opposite) direction from gear 18. The diameters of the pinion gears are selected so that gear 22 has a rotational speed slightly different than gear 18. Assuming a motor shaft speed of two thousand r.p.m., the speed differential between gears 18 and 22 might be on the order of ten r.p.m., dependent on the relative sizes of gears 24, 26 and 32. Preferably gear 26 has a diameter considerably less than the diameter of gear 32 or gear 24. Small gear 26 greatly increases the r.p.m. speed of gear 32 relative to the r.p.m. speed of gear 24. Since gear 32 has a relatively large diameter it is able to rotate the larger ring gear 34 at approximately the same r.p.m. speed as gear 24 and shaft 20. The aim is to operate the two bevel gears 22 and 18 at approximately the same speed, but in opposite directions.

The two large bevel gears 18 and 22 are in simultaneous meshing engagement with a plurality of small bevel gears 36 spaced approximately equidistantly around the large gear periphery; if the number of teeth on the large bevel gears is an uneven multiple of gears 36 an adjustment of the gear 36 spacing is required. Each gear 36 includes a stub shaft 38 rotatably mounted in a ring element 40 carried by the winding drum 12. The oppositely rotating gears 18 and 22 produce rotation of gears 36 around their individual axis. If gears 18 and 22 had the same r.p.m. each gear 36 would maintain a given location in space; drum 12 would be stationary. However, the aforementioned speed differential between gears 18 and 22 produces an orbiting motion of gears 36 around the shaft 20 axis, with a corresponding motion of drum 12. The orbital speed is mathematically one half the speed differential between gears 18 and 22. Thus, if the speed differential is ten r.p.m. then the orbital speed of gears 36 and drum 12 is five r.p.m. The output speed is determined by the dimensions selected for the pinion gears 24, 26 and 32.

The illustrated speed reducer is relatively compact, requires a relatively small number of bearings, and provides a relatively large speed reduction. Also, the speed reducer design is such that the output element 40 rotates around the same axis as the input element 20. Therefore the winding drum can be concentric with motor 10, so that a given size motor can be at least partially telescoped into the hollow winding drum, thereby reducing the outer dimension of the motor-drum package. The FIG. 1 assembly also has the advantage that the winding drum serves as a housing for the speed reducer, thereby saving housing space and associated expense.

Figure 4:
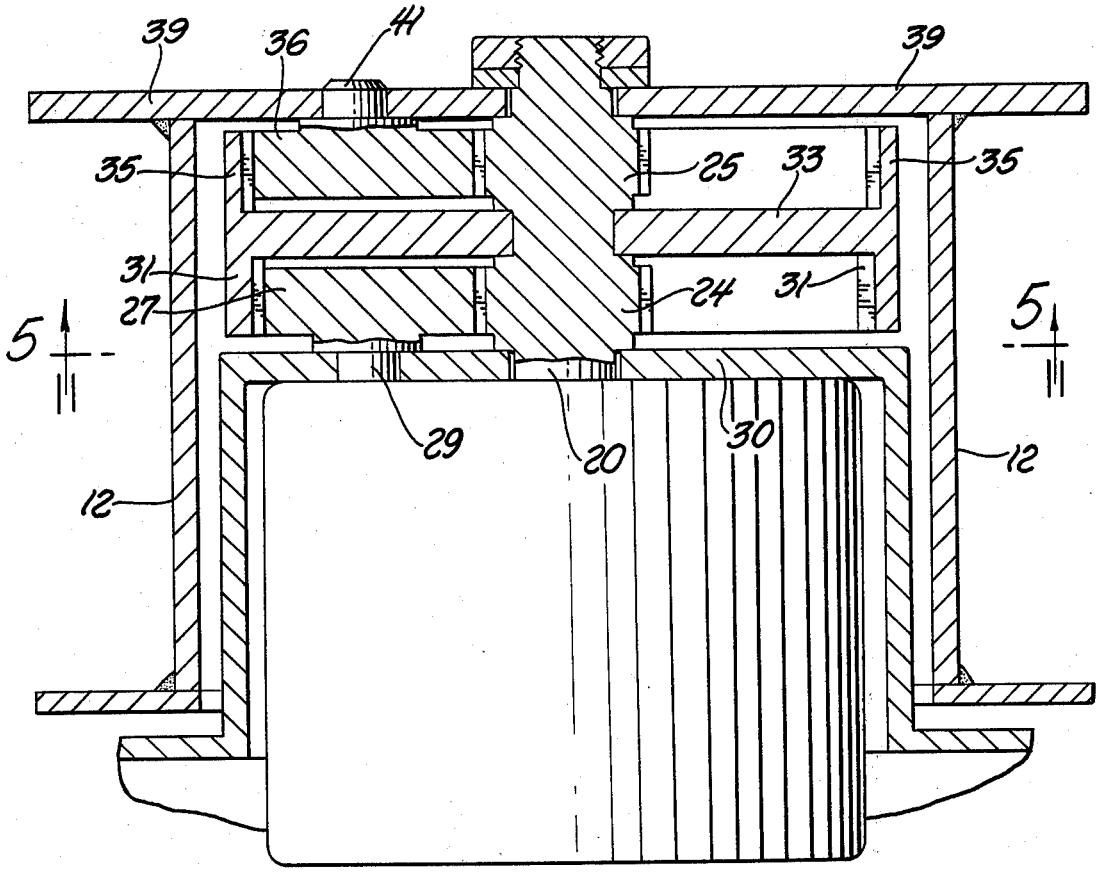
FIG. 4 is a sectional view taken through a second embodiment of my invention.

FIG. 4 illustrates a second form of the invention which is essentially the same as the FIG. 1 form except for the structure of the speed reducer. In the FIG. 4 construction the motor shaft 20 carries two pinion gears 24 and 25, preferably the same diameter. Gear 24 meshes with a pinion gear 27 that includes a stub shaft 29 rotatably mounted in stationary plate 30. Pinion gear 27 meshes with a ring gear 31 extending downwardly from a central plate 33 that is freely rotatable on shaft 20. Plate 33 also mounts a second ring gear 35 that meshes with a pinion gear 36. Gear 36 includes a stub shaft 41 that is rotatably positioned in a plate 39 that forms part of winding drum 12. Gear 36 is in mesh with aforementioned gear 25.

Ring gear 35 has a diameter that is slightly different than the diameter of gear 31; in the illustrated system gear 35 is slightly larger than gear 31. The slightly larger dimension of gear 35 requires that gear 36 be slightly larger than gear 27. Gear 27 rotates in place, whereas gear 36 slowly orbits around the shaft 20 axis; drum 12 follows the orbiting gear.

Figure 5:
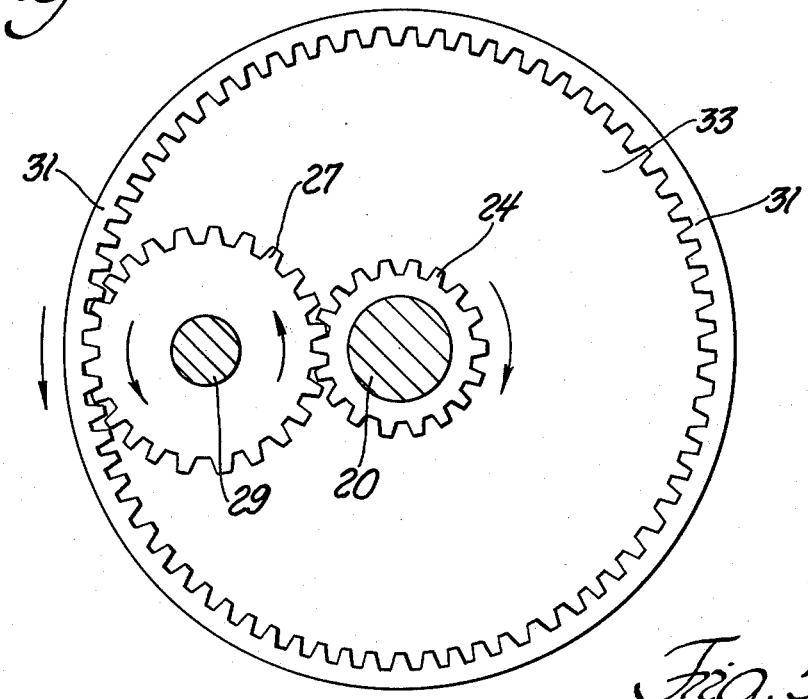
FIG. 5 is a sectional view on line 5—5 in FIG. 4.

Gear 36 functions like gear 36 of the FIG. 1 embodiment. Thus, it is floatably carried by the winding drum, and it is in mesh with two other gears 25 and 35 that rotate in opposite directions. Assuming the rotational directions shown in FIG. 5, gear 25 will rotate clockwise and gear 35 will rotate counterclockwise (under the driving force of gears 24 and 27). The speed differential between gears 35 and 25 produces an orbiting motion of gear 36 around the shaft 20 axis hence a corresponding motion of the associated drum 12.

It will be noted that gear 27 is a non-orbiting gear having a pre-determined location on plate 30. If gear 36 were to have the same diameter as gear 27, and gear 35 were to have the same diameter as gear 31, the gear 36 would also be a non-orbiting gear having a predetermined position; in that even drum 12 would take a fixed position. However, by sizing gears 35 and 36 to be slightly different than gears 31 and 27 it is possible to produce the desired orbital motion of gear 36. The magnitude of this orbital motion is related to the dimensional differences between gears 27 and 36. If gear 36 has a diameter only very slightly different than gear 27 then the orbital speed of gear 36 and the associated drum 12 will be relatively low. Relatively great speed reduction from shaft 20 to drum 12 is possible.

Speed reduction could also be achieved merely by forming gears 31 and 35 with different numbers of teeth. For example, assume a different situation wherein gears 27 and 36 are identical as to diameter and number of teeth; if gears 31 and 35 have the same diameter except for a difference in the number of teeth (e.g. one or two tooth difference) then output element 40 will have a slow orbital motion, similar to the motion obtained with the FIG. 4 device. A one or two tooth difference in gears 31 and 35 can be achieved with conventional gear-cutting technology, e.g. by indexing the gear blank or cutter through slightly different distances during the gear-cutting operations for the respective gears. Achievement of a speed differential by varying the number of gear teeth can also be employed in the gear arrangement of FIG. 1.

If it is necessary to achieve extremely large speed reductions, greater than 500 to 1, then the two described methods of achieving speed reduction can be combined. For example, in the FIG. 1 arrangement gears 24, 26 and 32 can be selected to drive gear 22 at a slightly different speed than gear 18; additionally gears 22 and 18 can be formed with a one tooth difference. The orbital motion of gears 36 is then determined both by the r.p.m. speed differential effect. These effects can be in opposite directions speedwise so that the resultant effect represents a very small speed difference in absolute terms; this can be done so as to provide very large output speed reductions.

In general, the FIG. 4 and FIG. 1 systems have similar advantageous characteristics as regards compactness, lightness and speed reducer simplicity. The illustrated speed reducers could be employed in other systems than motor-operated winches. However, the winch application is of especial usefulness because of the large speed reduction that is required.

I wish it to be understood that I do not desire to be limited to the exact details of construction shown and described for obvious modifications will occur to a person skilled in the art.

I claim:

1. In a motor-operated winch, the combination comprising a hollow winding drum having an end wall (16) and annular wall; means for rotating the drum around its axis comprising a motor (10) at least partially disposed within the drum so that the motor shaft is located on the drum axis, a plate (30) carried by the motor so that its periphery is engaged with the interior surface of the winding drum annular wall to provide a sealed space within the drum; and differential type speed reducer means located in the sealed space between the motor plate and drum annular wall for driving said drum at a speed substantially less than motor speed; said differential type speed reducer means including a first bevel gear (18) directly connected to the motor shaft for movement in one direction at one speed, a second bevel gear (22) floatably positioned on the motor shaft for movement in the opposite direction at a different speed; means for driving said second bevel gear comprising a first pinion gear (24) affixed to the motor shaft in the space immediately adjacent the aforementioned motor plate, a second relatively small pinion gear (26) mounted on the motor plate in meshed engagement with the first pinion gear, a third relatively large pinion gear (32) carried by the second pinion gear, and a ring gear (34) carried by the second bevel gear in mesh with said relatively large pinion gear; and third bevel gear means (36) carried by the drum in simultaneous meshing engagement with the first and second bevel gears; said gears and gear means being operatively arranged so that the third bevel gear means slowly orbits around the motor axis, carrying the drum therewith; said third bevel gear means comprising a plurality of bevel gears individually rotatable around separate radiating axis located in a plane normal to the motor axis, each of the last mentioned bevel gears being in simultaneous meshing engagement with the first and second bevel gears.

* * * * *